US005580300A

United States Patent [19]

Tsutsumi

[11] Patent Number: 5,580,300

[45] Date of Patent: Dec. 3, 1996

[54] METHOD AND APPARATUS FOR SURFACE POLISHING

[76] Inventor: Katsuji Tsutsumi, 130-2, Fukimae Makishimacho, Uji-shi, Kyoto, Japan, 611

[21] Appl. No.: 84,819

[22] Filed: Jun. 30, 1993

[51] Int. Cl.[6] ..... B24B 1/00

[52] U.S. Cl. ..... 451/35; 451/32; 451/104; 451/74; 451/113; 451/326

[58] Field of Search ..... 51/6, 7, 16, 17, 51/18, 22, 26, 163.1, 169.2, 313, 316

[56] References Cited

U.S. PATENT DOCUMENTS

| | | | |
|---|---|---|---|
| 929,804 | 8/1909 | Thompson | 451/104 |
| 3,513,604 | 10/1970 | Matsunaga et al. | 51/313 |
| 3,607,478 | 9/1971 | Henninges | 51/7 |
| 4,314,856 | 2/1982 | Steimel | 51/316 |
| 4,499,692 | 2/1985 | Balz | 51/313 |
| 4,709,507 | 12/1987 | Musschoot | 451/104 |
| 5,237,778 | 8/1993 | Baer | 51/313 |

FOREIGN PATENT DOCUMENTS

| | | | |
|---|---|---|---|
| 0150986 | 11/1980 | Japan | 51/163.1 |
| 61-42575 | 9/1986 | Japan . | |
| 3-202037 | 9/1991 | Japan . | |

*Primary Examiner*—D. S. Meislin
*Assistant Examiner*—Eileen P. Morgan
*Attorney, Agent, or Firm*—Knobbe, Martens, Olson & Bear

[57] ABSTRACT

A washing liquid and a granular substance in the quantity equivalent to or more than the liquid in the specific gravity are accommodated in a barrel in a manner to position the surface of the liquid above the top surface of a granular substance layer at a stationary state of the barrel, and the barrel is swung with an object to be washed which is accommodated therein to wash away stains firmly stuck.

In the same manner, various treatment liquid such as a plating liquid and a granular substance which possess conductivity or without conductivity are accommodated in the barrel with an object to be treated. By swinging the barrel, the treatment liquid and the granular substance are stirred and flow in the barrel so that the fluidity of the treatment liquid and granular substance relative to the object to be treated is improved to raise treatment effect and uniformity in the process. Thus, high quality surface treatment can be accomplished in high productivity. All kinds of surface polishing can be effectively conducted.

13 Claims, 10 Drawing Sheets

METHOD AND APPARATUS FOR SURFACE POLISHING

BACKGROUND OF THE INVENTION

1. Technical Field of the Invention

The present invention relates to a method and apparatus for surface polishing which includes surface washing of various kinds of containers and vessels such as tableware, utensils and parts, and various surface finish treatments such as mirror finish treatment, plating treatment, and pretreatment for plating process.

2. Description of Related Art

In a conventional tableware washing machine, a method of injecting liquid detergent toward tableware supported by a rack or basket is generally being adopted. However, there is a problem that a stain firmly stuck to tableware can not be removed completely.

In Japanese published unexamined patent application No. 3-202037, there is disclosed a tableware washing machine which is provided with a liquid detergent agitator, a vibrator for vibrating liquid detergent, a grasping device for grasping particles at a predetermined position and a liquid detergent heating apparatus wherein a rack for supporting tableware is provided in a case which accommodates a liquid detergent into which particles of different masses are mixed. In the tableware washing machine, a liquid detergent is flowed by stirring the liquid detergent with the agitator, and with the flow of the liquid detergent, the liquid detergent and the particles of different masses are brought in contact with the tableware whereby stains stuck to the tableware are removed. By vibrating both the liquid detergent and particles, even a small spot stuck to the tableware is removed. Furthermore, by seizing the particles when the liquid detergent is discharged, stains and particles are separated.

However, there are problems even in the tableware washing machine described above. First, washing effect is not sufficient even particles are brought in contact with the tableware accompanied with a flow of the liquid detergent since the velocity of the liquid detergent generated by the stirring is small compared with a case of an injection method, and the amount of particles which can be filled in is limited. Secondly, it may be considered that a washing effect might be improved by vibrating the liquid detergent with the vibrator, however, if a particle made of soft resin or elastic resin is used in order to protect tableware from being scratched, the vibration of the liquid detergent is absorbed and washing effect can not be sufficiently effected. Thirdly, even if a mixing ratio of particle is increased to raise the probability of contact with tableware by stirring up the liquid detergent, it causes a difficulty in stirring up the liquid detergent, and it can not contribute to improve washing effect. Moreover, stains of tableware can not be effectively removed since vibration of the liquid detergent by the vibrator is absorbed by the particles.

In Japanese published examined patent application No. 61-42575, there is disclosed a method of washing tableware thrown into a washing tank wherein beads and a liquid detergent in less amount than to fully fill up gaps between the beads are accommodated, and by vibrating the washing tank, the beads are moved in circulation along an inclined plane. However, even in such a tableware washing method, unless the liquid detergent is small in amount, washing can not be sufficiently performed by moving the beads in circulation. On the contrary, if the amount of the liquid detergent is too small, washing effect is remarkably dropped thereby inviting a problem to cause a difficulty in controlling the amount of liquid detergent for a stabilized washing effect. Furthermore, a washing process can not be sufficiently effected since the liquid detergent is small in absolute quantity. Since the washing tank has to be largely vibrated, it is required to provide countermeasures for noise and vibration.

In a mirror finish treatment, a barrel finishing method is adopted wherein metal balls and an object to be treated are accommodated in a rotary barrel when an object to be treated is small in size, and the barrel is rotated for a finishing process. However, there is a problem that washing can not be effected satisfactorily and accurately. For a comparatively larger object, there is left only a manual buff finishing method, however, washing effect is extremely lowered. In other conventional methods such as chemical polishing, barrel plating, pretreatment for the barrel plating and barrel electrolytic polishing, high-grade treatment can not be effected, and moreover, structure of an apparatus becomes complicated.

SUMMARY OF THE INVENTION

A primary object of the present invention is to provide a surface polishing method and an apparatus which are capable of effectively performing a surface finish which includes a surface washing and various surface treatment.

Another object of the present invention is to provide a washing method and a washing machine which are capable of effectively and neatly washing tableware, utensils and the like.

A further object of the present invention is to provide a method which is capable of effectively performing a mirror finish treatment for almost all objects to be treated including large large-sized objects.

A still further object of the present invention is to provide a surface treatment method and an apparatus which are capable of performing high-grade treatment in high productivity by effectively and uniformly performing various chemical surface treatment, plating treatment, pretreatment for the plating treatment, and surface treatment of various electrochemical surface treatment such as electrolytic polishing.

In order to accomplish the above-stated objects, the present invention is arranged to accommodate, in a barrel, a liquid and a granular substance in the quantity equivalent to or more in specific gravity than the liquid at a mixing ratio of positioning the upper surface of the liquid properly above the top of a granular substance layer under a stationary state of the barrel, and a surface finishing process is conducted by swinging the barrel. The present invention is characterized by its surface finishing method and apparatus.

The maximum limit of ratio of a liquid to a granular substance is that the depth of the liquid above a granular substance layer is less than half of the height of the granular substance layer under a stationary state of the barrel. It may be preferable to prepare the depth of the liquid above the granular substance layer several centimeters. With an arrangement to swing the barrel substantially at a uniform velocity except swing ends, the contents in the barrel securely flow in the shape of the FIG. 8 on the vertical plane, and the contents are actively flowed and stirred mutually.

In a washing process of tableware and the like, a liquid such as water, warm water, water and warm water composed of a detergent and various chemicals, and a liquid detergent composed of various chemicals are utilized. As for a granular substance, soft resin and elastic body such as rubber are mainly utilized. An object to be washed is supported in a basket which is placed in a barrel, and vibration is added to the basket according to requirement. If the influence of vibration and noise are small, vibration may be added to the entire barrel so that washing effect is improved more.

In a mirror finish treatment, only water or warm water may be used as an appropriate liquid, however, a liquid to which a surface active agent is added may preferably be utilized. A granular substance harder than the surface of an object to be washed may preferably used as an appropriate granular substance.

In a chemical surface treatment, a chemical liquid and a granular substance which is not affected by a treatment liquid is used.

In an electrochemical treatment, a liquid such as plating liquid, electrolyte, and alumite treatment liquid are utilized corresponding to a treatment to be performed. As for a granular substance, conductive granular substance or a hard granular substance according to requirement is utilized. An object to be treated may be thrown into the barrel like treatment liquid and granular substance, or it may be supported in a basket or the like.

According to the above-mentioned surface washing method and apparatus, a granular substance is filled into a liquid detergent accommodated in a barrel in the quantity equivalent to or more in specific gravity than the liquid detergent in a manner to position the surface of a granular substance layer than the surface of the liquid detergent, and the barrel is swung so that the granular substance and liquid detergent flow with complicated movement accompanied by the swing of the barrel even if the granular substance is filled in a large quantity. Since the large amount of granular substance flows in the liquid detergent closely contacting each other, an object to be washed placed therein is frequently brought in contact with the granular substance and liquid detergent repeatedly contacting and hitting against each other, and the object to be washed is effectively washed.

If the amount of a liquid detergent is not enough and the upper surface of the liquid detergent is lower than the top surface of a granular substance layer in a stationary state of barrel, the fluidity of the granular substance is lowered and the granular substance can not be fully scattered thereby lowering washing effect since stains are not completely separated because of insufficient quantity of the liquid detergent.

On the other hand, if the amount of the liquid detergent is large and the depth of the liquid detergent above the top surface of a granular substance layer is more than half of the height of the granular substance layer, the granular substance is scattered in the liquid detergent to cause insufficient contact and hitting against an object to be washed thereby washing effect is lowered since the liquid detergent and the granular substance moves without producing a state of sufficient contact and scattering.

In the case when an object to be washed is supported in a basket, and the basket is placed in a barrel, a granular substance and liquid detergent effectively contact the object to be washed, and by adding vibration to the basket, washing effect is improved since the vibration is effectively transmitted to the object to be washed.

According to a surface treatment method of the present invention, with the same effect as observed in the above-mentioned surface washing, a treatment liquid and granular substance flow mutually contacting and hitting each other when a barrel is swung, and the fluidity of the liquid and granular substance against an object supported in a basket or an object flowing with the liquid and granular substance is large so that effective and uniform treatment can be conducted to provide high productivity and various kinds of high-grade treatments.

These and other objects and features of the present invention will become more apparent from the following description taken in conjunction with the accompanying drawings which illustrate specific embodiments of the invention.

BRIEF DESCRIPTION OF DRAWINGS

FIG. 11 is a fragmentary sectional front view showing electrode to be thrown in.

DESCRIPTION OF THE PREFERRED EMBODIMENTS

A first embodiment of the present invention will now be described hereinafter referring to the accompanying drawings.

Figure 1:
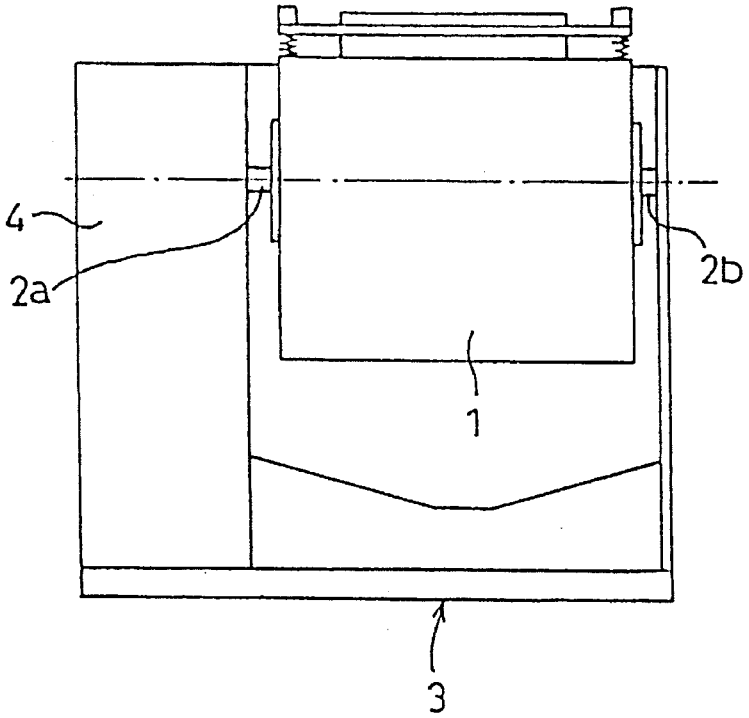
FIG. 1 is a front view showing the whole construction of a washing machine in a first embodiment of the present invention.

In the FIG. 1 which shows the whole construction of a washing machine, reference number 1 represents a barrel provided for washing operation and is swingably supported by a frame 3 through shafts 2*a* and 2*b* disposed at both ends of the barrel in the middle portion thereof in vertical direction. One of the shafts 2*a* is swingably arranged to be driven by swing driving means 4 provided in the frame 3.

Figure 2:
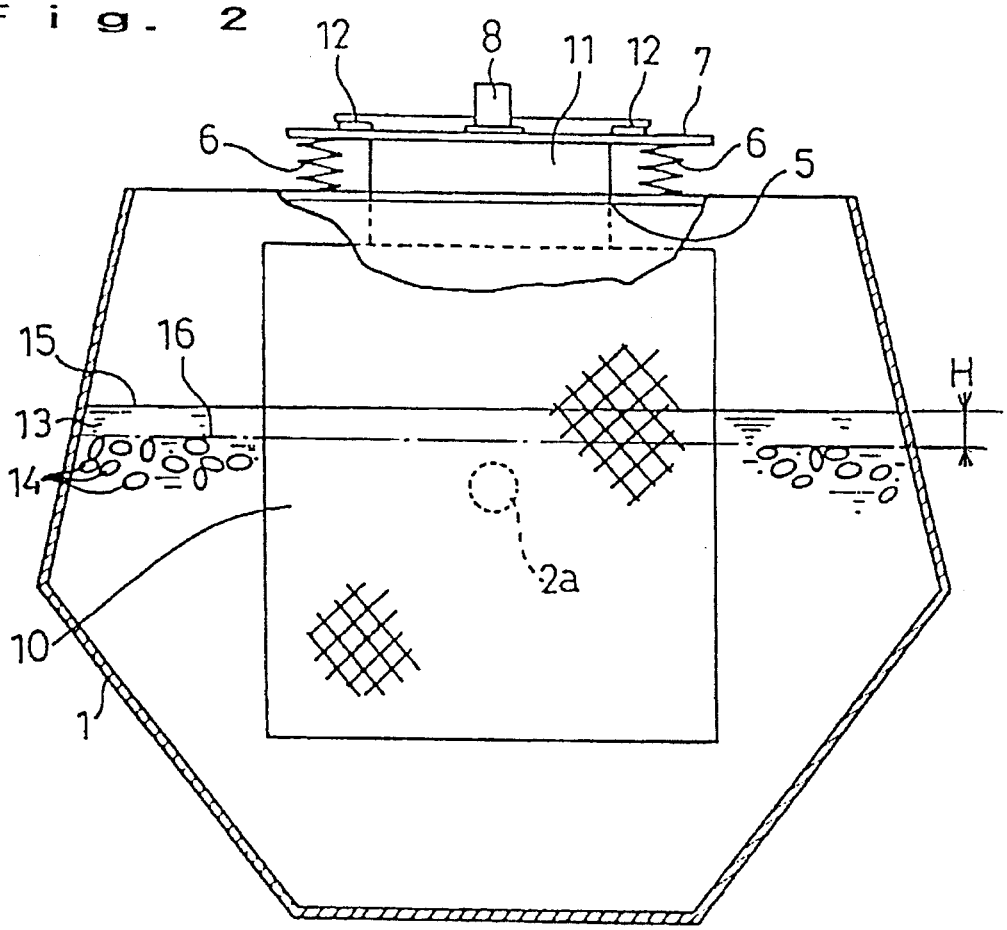
FIG. 2 is a sectional side view showing a part of barrel.
Figure 3:
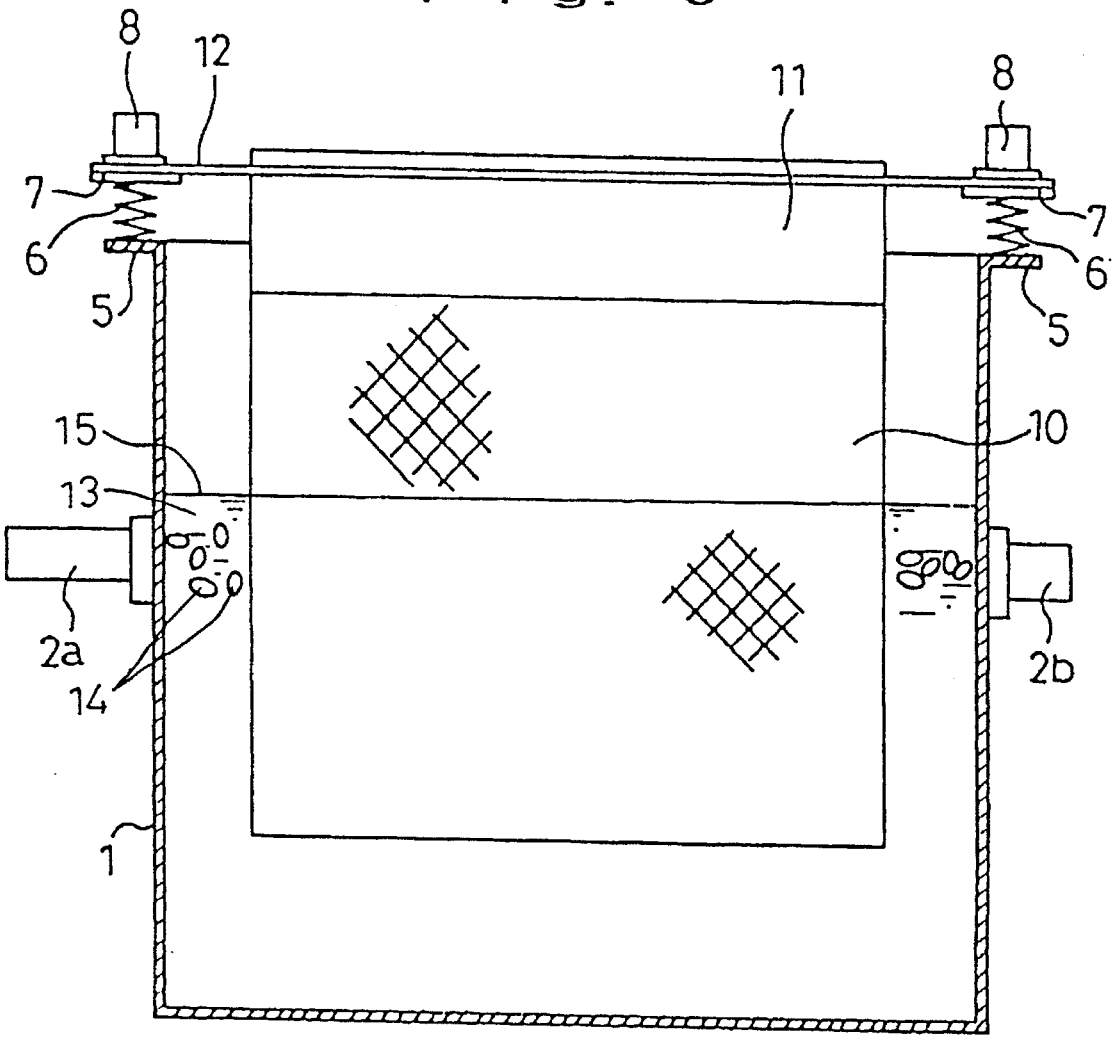
FIG. 3 is a front view in vertical section of the barrel.

In the FIGS. 2 and 3, the barrel 1 constitutes a polygonal container with its upper surface opened, and flanges 5 are provided at both upper ends of the barrel. A receiving plate 7 is disposed through springs 6 on both upper ends of the flanges, and air vibrators 8 are attached to the receiving plate 7 at the center thereof.

Reference numeral 10 shows a basket for supporting and accommodating an object to be washed, and a supporting section 11 is provided above the basket. There are provided a pair of supporting rods 12 whose both ends are supported by the receiving plate 7.

In the barrel 1, there are accommodated a liquid detergent 13 and a granular substance 14 composed of soft resin or elastic resin in the quantity equivalent to or more in specific gravity than the liquid detergent in a manner to position the upper surface of a liquid detergent surface 15 several centimeters above the top surface of a granular substance layer 14 at a stationary state of the barrel 1. The quantity of the liquid detergent 13 relative to the granular substance 14 is to be arranged in a manner to position the upper surface of the liquid detergent 15 at least above the top surface of the granular substance layer 14 or even at the maximum, a depth H of the liquid detergent 13 above the top surface of the granular substance layer 14 is required to be less than half of the height of the granular substance layer 14.

Water or warm water may be used as a liquid detergent 13, however, if a liquid mixed with a surface active agent or other detergent is used, washing effect is improved. Various kinds of solvent and chemical liquid may also be utilized according to a requirement of use. A rubber of diameter several mm or a ball made of soft synthetic resin may preferably be utilized as a granular substance 14 in order not to scratch an object to be washed. A material in which an abrasive is contained in those may also be utilized. Corresponding with the material of an object to be washed, glass beads, ceramic ball, and various kinds of materials of granular substances may also be utilized by optionally selecting a shape according to requirement of use.

Now, description will be made on a washing action of the washing machine with the construction described above.

The basket 10 which accommodates an object to be washed is inserted into the barrel 1 where a liquid detergent 13 and a granular substance 14 made of soft resin or elastic body are accommodated, and the basket is supported by the supporting rod 12 placed on the receiving plate 7. If the basket 10 can not be smoothly inserted into the barrel 1 due to a large amount of granular substance 14 being accommodated therein, it may be smoothly inserted thereinto by merely shaking the basket.

Figure 4:
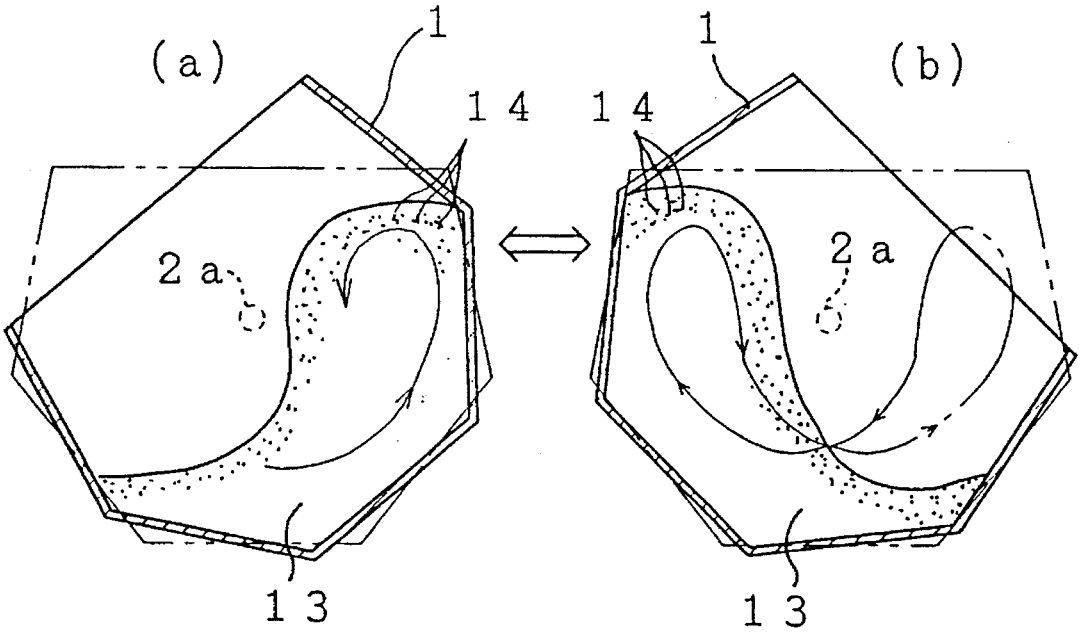
FIG. 4 is an explanation drawing showing a state of flow of the contents in the barrel.

With the basket 10 supported and placed in the barrel 1, the barrel 1 is swung substantially at a uniform velocity by the swing driving means 4 through the shaft 2*a*. Accompanied with the movement of the barrel 1, even if the granular substance 14 is filled in the barrel in a large quantity, the granular substance 14 and the liquid detergent 13 flow in the shape of the FIG. 8 with a complicated action by reciprocally repeating actions (a) and (b) shown in the FIG. 4. As a result, a sliding layer in one direction is formed on the outer layer of the contents in the rotary barrel, while sliding layers in opposite directions are reciprocally formed at both ends of the movement. With a flow of the whole contents of the barrel, a large quantity of granular substance 14 come in close contact with each other and stirred in the liquid detergent 13, and an object to be washed which is supported in the basket is placed in the barrel under the state as described above. The granular substance 14 and the liquid detergent 13 repeat frequent contact and hitting against the object to be washed, and eventually, the object to be washed is effectively washed. Since the object to be washed is held in the basket 10 in a manner not to flow along with the granular substance 14 and liquid detergent 13, the granular substance 14 and the liquid detergent effectively contact the object to be washed to improve washing effect.

With installation of the air vibrator 8 on the basket 10, vibration is effectively transmitted to the object to be washed, and the frequency of contact of the object to be washed with the granular substance 14 and liquid detergent 13 is more increased to highly improve washing effect.

In the above-described embodiment, an example is shown wherein an object to be washed is accommodated in the basket 10 and vibration is added to the basket 10, however, washing can be effectively performed even without adding vibration. Further, in the above-described embodiment, an example is shown wherein an object to be washed is accommodated in the basket 10 which is then placed in the barrel 1, however,, the object to be washed may be placed directly into the barrel 1.

As stated above, according to the present invention, even if a large quantity of a granular substance 14 is filled, the granular substance 14 and a liquid detergent 13 flow in a complicated movement accompanied by the movement of the barrel 1 under a state that the granular substance 14 in the quantity equivalent to or more specific gravity than the liquid detergent 13 is filled in a manner to position the top surface of the granular substance 14 lower than the upper surface of the liquid detergent 15. A large amount of granular substance 14 flows under a state that they come to close contact with each other and stirred in the liquid detergent 13, and by placing an object to be washed therein, the granular substance 14 and liquid detergent 13 repeat frequent contact and hitting against the object to be washed, and the object to be washed is washed effectively.

A description will now be made on a concrete construction of the swing driving means 4 referring to the FIG. 5 through FIG. 8.

Figure 5:
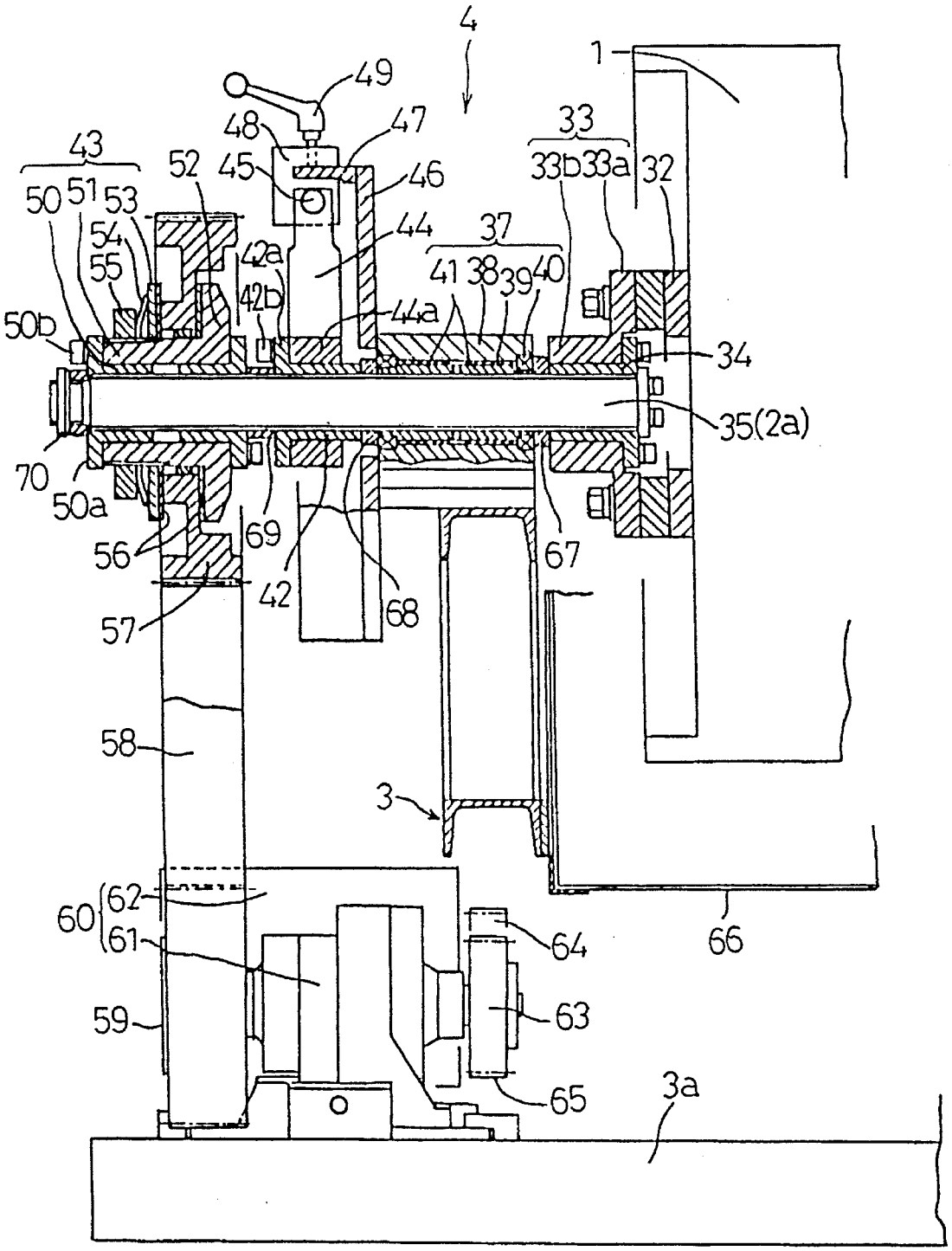
FIG. 5 is a front view in vertical section showing a concrete example of a structure of swing driving means.

In the FIG. 5, a frame plate 32 is fixed on both end surfaces of the barrel 1. To the frame plate 32 on one of the end surfaces of the barrel 1, a coupling bracket 33 provided with flange section 33*a* and boss section 33*b* is attached. In the inner circumference of the boss section 33*b*, a spline shaft 35 which functions as a shaft 2*a* is fitted through a toothed sleeve 34. The spline shaft 35 is rotatably supported by a bearing 37 provided on a frame 3.

The bearing 37 rotatably provides a pair of toothed rotary sleeves 41 through a bearing metal 39 and a thrust bearing 40 in a main body of bearing 38, and the spline shaft 35 is inserted through the toothed rotary sleeve 41. The spline shaft 35 is projected from the bearing 37, and a swing arm attaching sleeve 42 and toothed pulley attaching means 43 are fitted thereinto. In the inner circumference of the swing arm attaching sleeve 42, there is formed a spline, and a boss section 44*a* of a swing arm 44 is fitted the outer circumference thereon, and the boss section 44*a* is connected and tightened with a flange section 42*a* by a bolt 42*b*. At the leading end of the swing arm 44, a contact piece 45 made of an elastic body such as rubber is attached. On the end surface of the main body of bearing 38, a disc 46 in diameter a little larger than the length of the swing arm 44 is fixed, and a stopper attaching ring 47 is fixed on the outer circumference thereof. A pair of stopper pieces 48 are movably attached to the stopper attaching ring 47 to be positioned at an optional position by a fixing device 49.

The toothed pulley attaching means 43 is constructed as follows. On the outer circumference of a pair of toothed sleeves 50 in the inner circumference of which a spline is formed, a rotary sleeve 51 is fitted, and both ends are connected and tightened with a flange section 50*a* of the toothed sleeve 50 by a bolt 50*b*. On one end of the rotary sleeve 51, there is formed a receiving collar 51, and on the outer circumference of the other end, a pressing plate 53 and a belleville spring 54 are fitted and screwed by a pressing nut 55. The inner circumference of a toothed pulley 57 is nipped through a friction plate 56 disposed opposite to the receiving collar 52 and pressing plate 53. From the toothed pulley 57, a turning force is transmitted to the spline shaft 35 through the rotary sleeve 51 and toothed sleeve 50, and it is arranged to safely lose a turning force which exceeds a frictional force.

The toothed pulley 57 is connected to a driving pulley 59 of driving means 60 provided on a base 3*a* of the frame 3 through a timing belt 58. The driving means 60 comprises a reduction gear 61 and a driving motor 62, and the driving pulley 59 is equipped with an output shaft of the reduction gear 61. Input shaft of the reduction gear 61 and output shaft of the driving motor 62 are connected by a timing belt 65 which winds toothed pulleys 63, 64.

Figure 6:
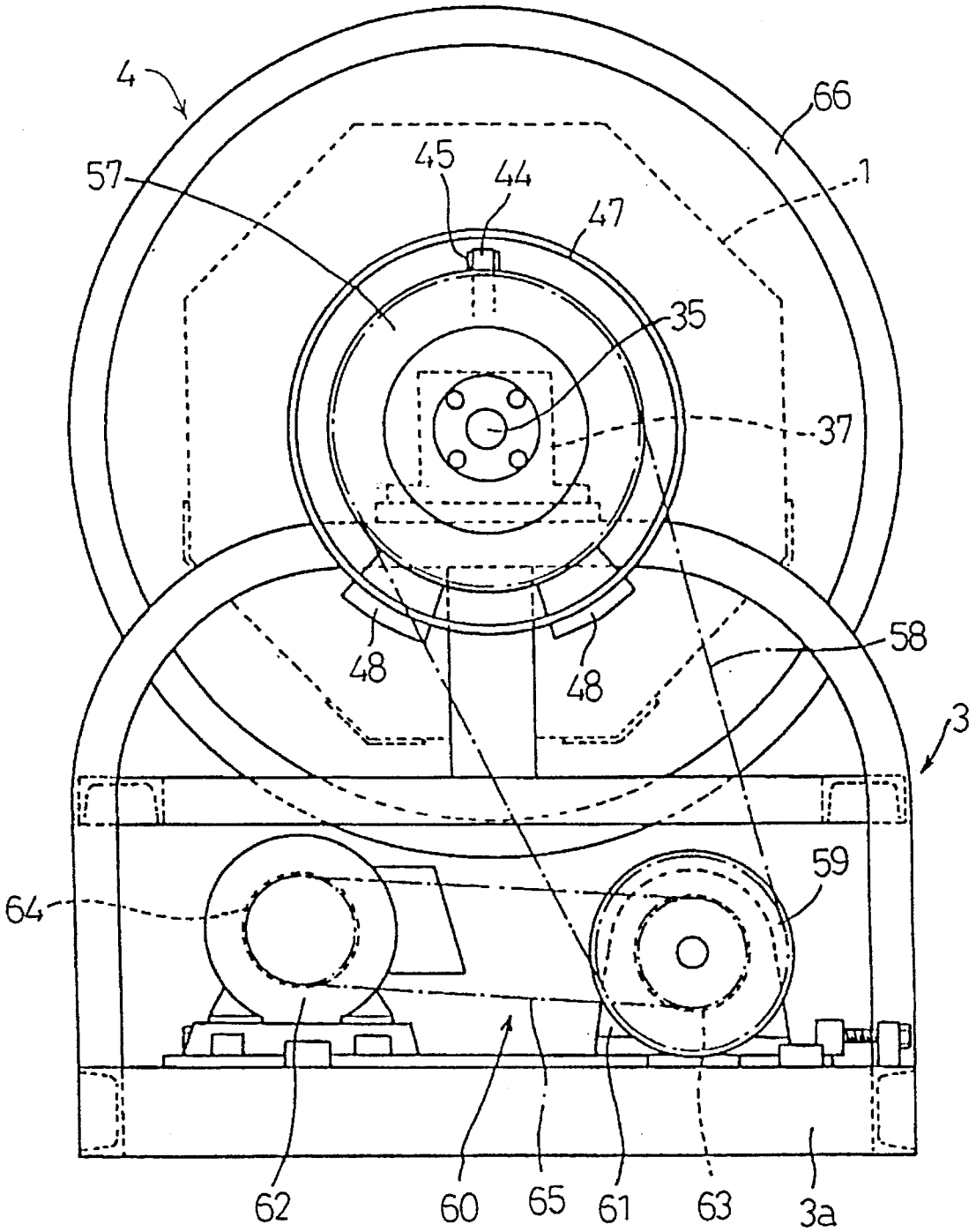
FIG. 6 is a side view showing the structure of the swing driving means.

In the FIGS. 5 and 6, reference numeral 66 represents a cylindrical safety cover which covers the outside of the barrel 1, numerals 67 and 68 show distance pieces provided between one end of the bearing 37 and the connecting bracket 33, and between the other end of the baring 37 and the swing arm attaching sleeve 42, numeral 69 a distance piece provided between the swing arm attaching sleeve 42 and the toothed sleeve 50, and numeral 70 represents a pressing nut screwed in the shaft end portion of the swing spline shaft 5 respectively.

The driving motor 62 comprises a high-resistance squirrel-cage motor which possesses high starting and acceleration torque characteristics, and is provided with a D.C. dynamic braking function to obtain a large damping force so that starting, inversion and suspension can be frequently performed.

Figure 7:
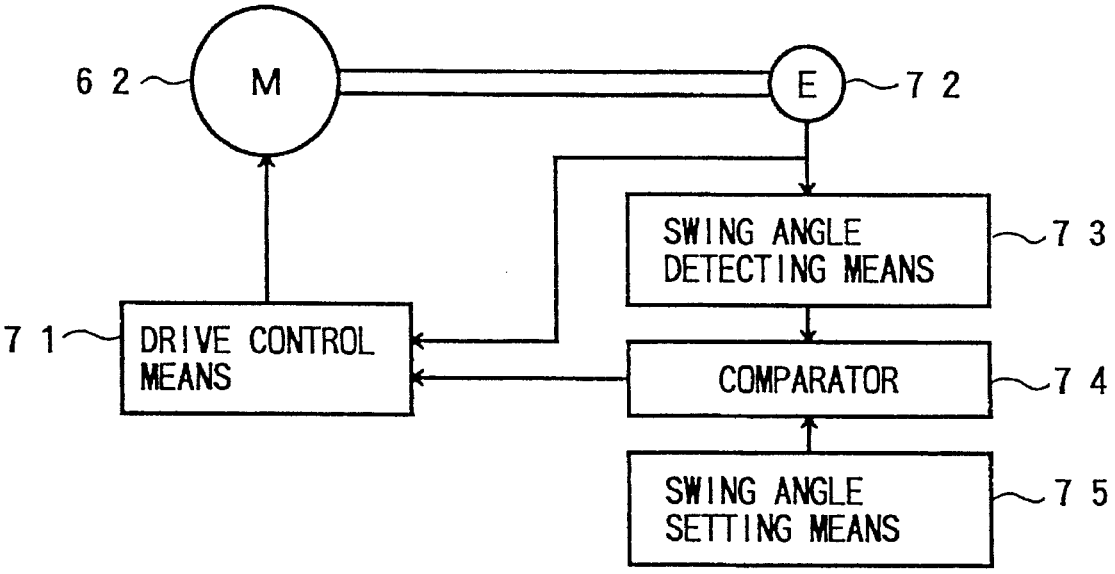
FIG. 7 is a block diagram of driving control.

As shown in the FIG. 7, the driving motor 62 is driven and controlled by drive control means 71 to which a detecting signal from an encoder 72 is inputted in order to rotate at a uniform velocity. The encoder 72 is provided for detecting a rotating position of the output shaft of the driving motor 62 or the spline shaft 35. A detecting signal from the encoder 72 is also inputted in a swing angle detecting means 73 which detects a swing angle of the swing spline shaft 35, and the detected swing angle is inputted in a comparator 74, wherein the detected swing angle is compared with a drive suspension swing angle optionally set by swing angle setting means 75. When the angle reaches the drive suspension swing angle which has been set, a signal is output to the drive control means 71.

Description will now be made on a swing drive control of the barrel 1 referring to the FIG. 8.

Swing position of the spline shaft 35 is momentarily detected by the encoder 72, and the driving motor 62 is controlled by the drive control means 71 so as to swing the spline shaft 35, i.e. the barrel 1, at a constant velocity V. At the same time, an actual swing angle of the spline shaft 35 is detected by the swing angle detecting means 73, and when the angle is reached a drive suspension swing angle preliminarily set by the swing angle setting means 75, a signal is output to the drive control means 71 from the comparator 74 to stop the drive of the driving motor 62 which is braked for a predetermined time t by a built-in timer. Then, the driving motor 62 is started in a reverse direction.

On the other hand, the washing tank 1 is swung by the force of inertia rapidly reducing velocity, and the barrel 1 is forced to stop mechanically when the contact piece 45 provided at the leading end of the swing arm 44 hits the stopper piece 48 at a proper position outside a drive suspension swing angle. After a predetermined time t of the timer is elapsed, the driving motor is started in a reverse direction, and is then driven and controlled at a uniform velocity V.

By repeating the above-described actions, the barrel 1 is swung in reciprocating motion substantially at a uniform velocity within a swing range set by the stopper piece 48 without having any influence on the condition of flow in the barrel 1. The swing range may variably easily be changed by resetting a set value of the swing angle setting means 75 and adjusting a fixed position of the stopper piece 48.

According to the swing driving means 4 described above, a simple and durable construction without providing complicated uniform velocity mechanism can be arranged at inexpensive cost since the driving means 60 is only connected to the spline shaft 35 through rotation transmitting means. The barrel 1 can be driven substantially at a uniform velocity by driving the driving motor 62 in reciprocating motion within a drive suspension swing angle preliminarily set by the drive control means 71. Moreover, a swing range of the barrel 1 can be set stably since the barrel is forced to stop mechanically by the stopper piece 48 at a proper angle outside the drive suspension swing angle after rapidly reducing a swing velocity upon the drive suspension swing angle is detected. Since the barrel is braked before it is mechanically stopped by the stopper piece 48, excessive force is not acted on the stopper piece 48. Furthermore, the swing range may variably be changed by simply setting a drive suspension swing angle and adjusting a position of the stopper piece 48. With the simple and durable construction in expensive manufacturing cost as described above, it becomes possible to swing the barrel 1 substantially at a uniform velocity within an optional swing range.

For the swing driving means 4, it may be arranged in various ways as long as the barrel is swung substantially at a uniform velocity except the swing end. For example, a mechanism combined with a uniform velocity moving mechanism provided with cylindrical cam and rack pinion, a mechanism combined with heart cam and lever link, and a cylinder apparatus which is driven by a hydraulic machine provided with flow control function may be applied to the present invention.

A second embodiment of the present invention will now be described referring to the FIG. 9 wherein the present invention is applied to a mirror finish treatment apparatus.

The overall construction of a washing machine in the first embodiment of the present invention is applied as it is. Common elements such as the barrel 1 and the swing driving means 4 are shown by corresponding numerals, and detailed description will be omitted.

Figure 9:
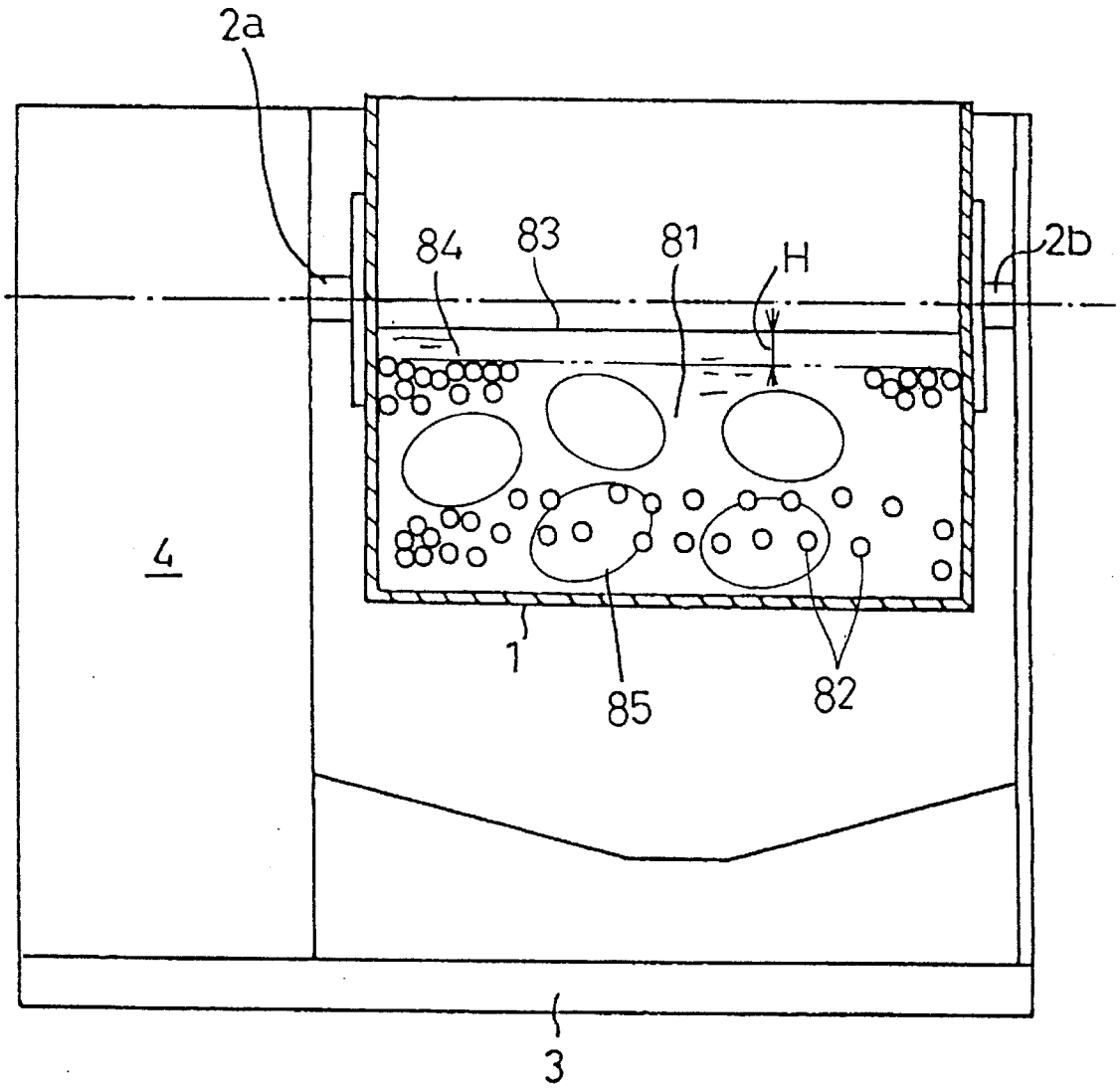
FIG. 9 is a front view in vertical section showing a mirror finish treatment apparatus in a second embodiment of the present invention.

In the FIG. 9, there is shown a machine which is not provided with a basket 10 as an example. In the barrel 1, a treatment liquid 81 in which a surface active agent is added to water or warm water and a granular substance 82 composed of a smooth surface ceramic ball are accommodated. A ratio of the treatment liquid 81 and the granular substance 82 is arranged, like a case of the first embodiment of the present invention, to position the upper surface of a treatment liquid 83 above the top of a granular substance layer 84 at a stationary state of the barrel 1, and a depth H of the treatment liquid 81 is set to be within a range less than half of the height of the granular substance layer 84 wherein the H is preferably set several centimeters. Reference numeral 85 represents an object to be treated.

Figure 8:
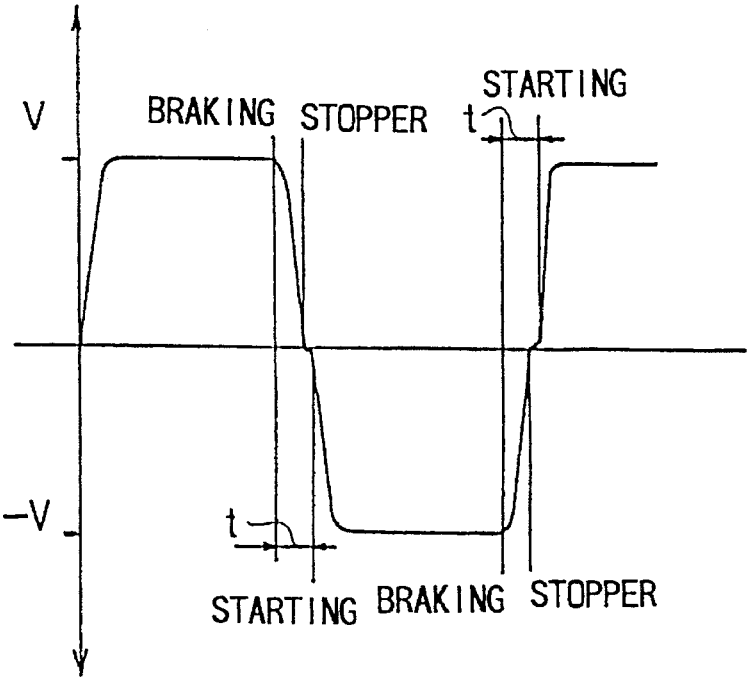
FIG. 8 is an explanation drawing showing operation timing in the swing driving means.

In a mirror finish treatment apparatus with a construction as described above, the treatment liquid 81 and the granular substance 82 composed of ceramic ball start to flow accompanied by a swing movement of the barrel 1 in reciprocating motion substantially at a uniform velocity along with the object to be treated 85 forming the shape of the FIG. 8. In said movement, the surface of the object to be treated is frequently and repeatedly hit by the hard and smooth surface granular substance 82 and the liquid treatment 82 which contains a surface active agent, and eventually, the surface of the object to be treated 85 is effectively finished in a mirror-like condition in a short period of time. Even if an object to be treated 85 is large in size, if it can be accommodated in the barrel 1 leaving some space, it can be easily treated.

In the second embodiment of the present invention, if a chemical treatment liquid such as a chemical polishing liquid is used as a treatment liquid 81, and a material which is not violated by the chemical treatment liquid is used as a granular substance 82, they may be applied to a chemical treatment for a chemical polishing and the like.

A third embodiment of the present invention will now be described referring to the FIGS. 10 and 11 wherein the present invention is applied to a barrel plating.

An overall construction is similar to each one of the embodiments described above. Like construction elements are shown by corresponding characters, and detailed description will be omitted.

Figure 10:
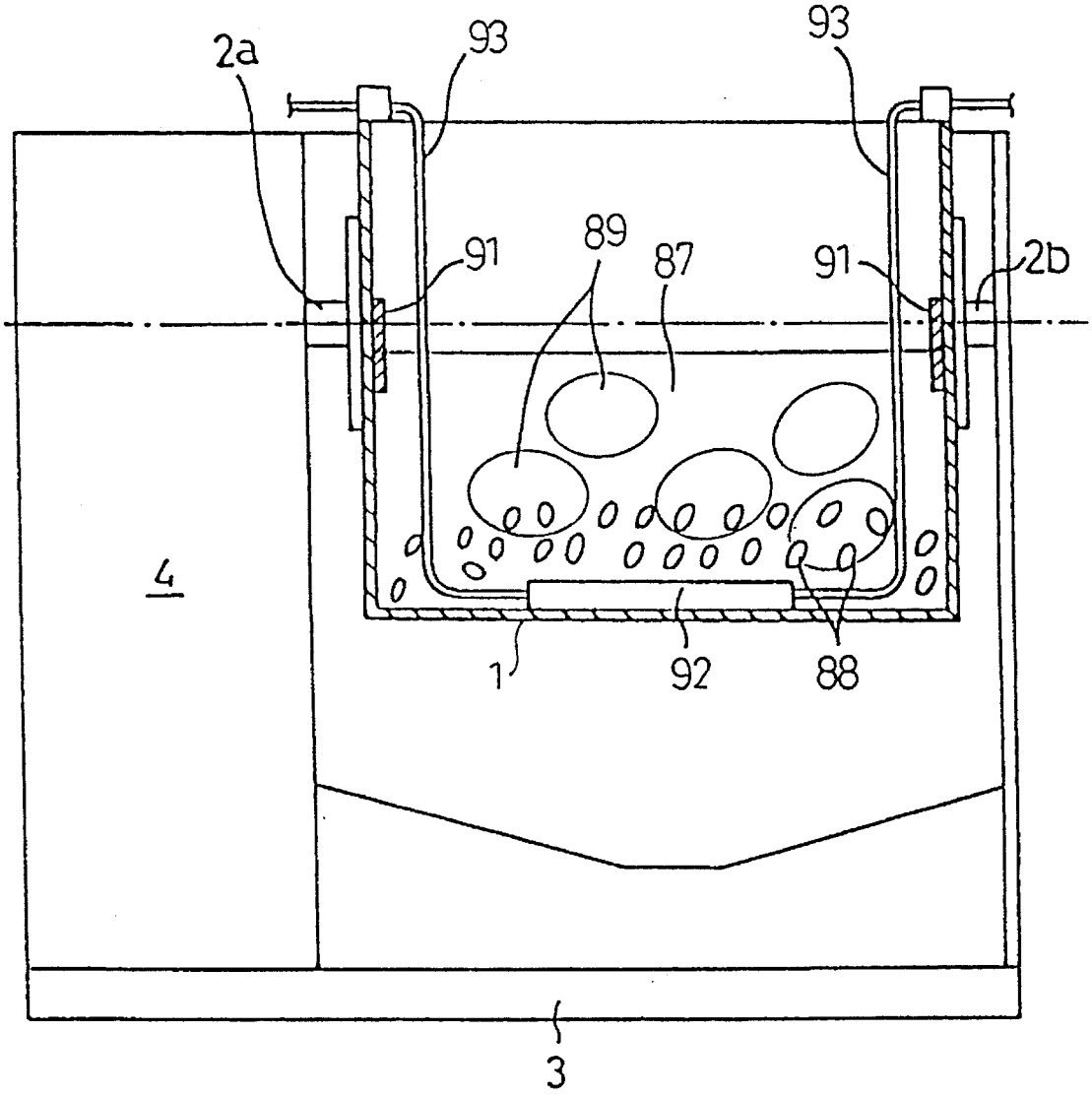
FIG. 10 is a front view showing the whole construction of a barrel plating apparatus in a third embodiment of the present invention.

In the FIG. 10, reference numeral 1 shows a barrel 1 inside of which an insulated and wear-resistance lining is provided though it is not shown in the figure. A fabricated tank constructed by both ends plate and a plurality of side plates is utilized in order to facilitate repair and exchange when the lining is worn and deteriorated.

An electrode 91 for positive pole is provided surrounding the entire circumference of inner wall of the barrel 1 at a position between the middle portion and top portion of the inner wall, and is connected to a power source by energizing means. At the bottom in the barrel 1, an electrode 92 for negative pole is disposed, and a lead wire 93 extended from the electrode 92 is pulled outside to be connected to the power source. A plating liquid 87 is accommodated to the height where at least a part of the electrode 91 is always immersed.

Figure 11:
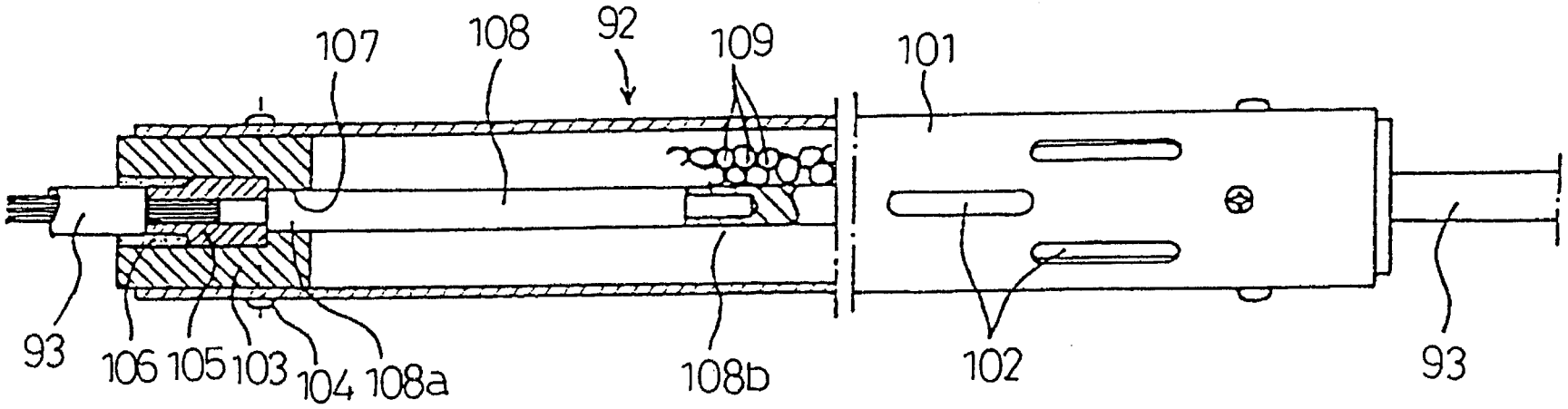
Figure 12A:
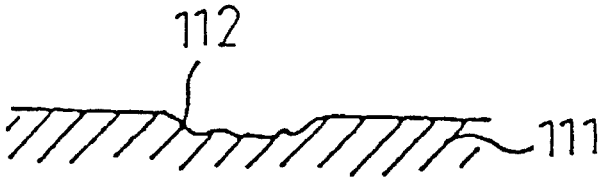
FIG. 12 is an explanation drawing showing an action of the third embodiment of the present invention applied to a preliminary process for a plating treatment.
Figure 12B:
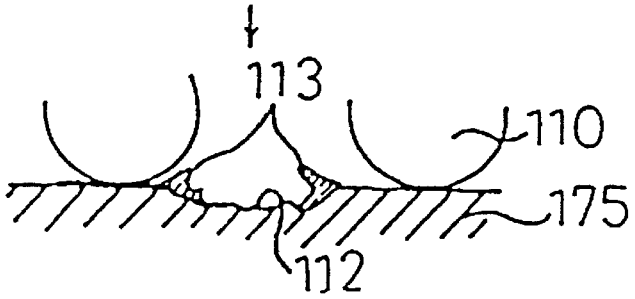
Figure 12C:
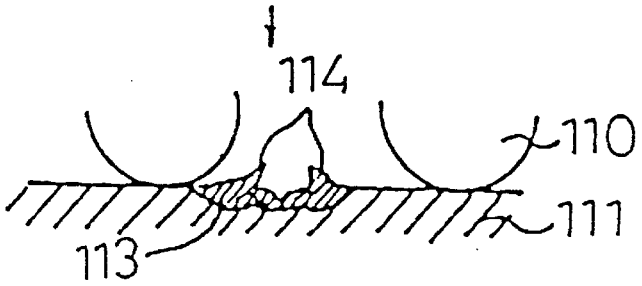
Figure 12D:
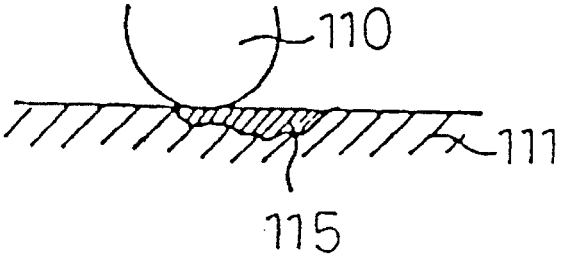

In the FIG. 11 in which the electrode 92 is shown in detail, reference numeral 101 represents a cylindrical member composed of insulating synthetic resin, and a multiplicity of apertures 102 for applying an electric current are formed in the circumferential wall except both end portions. Into both end portions of the cylindrical member 101, an edge member 103 composed of insulating synthetic resin is inserted and is removably fixed by a screw 104. In the core portion of the edge member 103, a copper conductive sleeve 105 is incorporatively disposed. The end portion of the lead wire 93 is connected to the conductive sleeve 105, and sealed by a filling material 106. An insertion hole 107 is formed in the edge member 103 inside the cylindrical member 101, and edge portion 108*a* of the cylindrical electrode member 108 is inserted to be connected with the conductive sleeve 105. The cylindrical electrode member 108 is plurally divided in a direction of core of shaft and mutually connected at a fitting connection section 108*b*. In a gap between the cylindrical electrode member 108 and the cylindrical member 101, polishing media 109 is filled in a manner to move freely therein.

Description will be made on a plating treatment action wherein an apparatus as constructed above is utilized.

A plating liquid 87, a conductive granular substance 88 and an object to be plated 89 are accommodated in the barrel 1, and a swing driving means 4 is operated by applying voltage to the electrode 91 and the electrode 92 to swing the barrel 1, and a plating treatment for the object to be plated is conducted. At this plating process, the plating liquid 87, conductive granular substance 88 and the object to be plated 89 are stirred and flow accompanied by the swing movement of the barrel 1, and the plating liquid 87 and conductive granular substance 88 flow in all directions relative to the object to be plated 89. Accompanied with the swinging movement of the barrel 1, the plating liquid 87 passes through the outlets 102 of the cylindrical member 101 in the electrode 92 so that electric current is sufficiently applied even if the cylindrical electrode member 108 is disposed in the cylindrical member 101. Electrochemical reaction is thus effectively and uniformly performed to accomplish a high productive and high quality plating treatment without having uneven electricity application to the object to be plated 89 and uneven density in the plating liquid 87.

With an inertia which acts when the barrel 1 is swung and the flow of the plating liquid 87, the polishing media 109 filled in the cylindrical member 101 is incessantly moved, and accompanied with the movement of the media 109, the surface of the cylindrical electrode member 108 is polished by the polishing media 109. Therefore, even if a corrosive film is formed on the surface of the cylindrical electrode member 108, it is immediately removed and electric conductivity is secured for a long time thereby maintaining a high plating effect. In the case if the cylindrical electrode member 108 is worn, it can be simply and easily exchanged by pulling out the edge member 103 by removing the screw 104, and assembling them in reverse order.

In this embodiment, a barrel plating apparatus has been exemplified wherein an object to be plated is directly thrown into the barrel 1 together with a plating liquid and a conductive granular substance. However, like a case of the first embodiment of the present invention, it may also be arranged to dispose a basket 10 in which an object to be plated is accommodated and to electrify the basket 10 to negative electrode.

In the above embodiment, a plating treatment has further been exemplified, however, it may also be preferably applied to a preliminary process of plating treatment with the same construction. More particularly, a smooth surface granular substance 110 such as ceramic ball harder than a metal to be plated is accommodated in the barrel 1 besides a plating liquid 87 and conductive granular substance 88, and an object to be treated 111 is thrown thereinto for a plating treatment.

When there is a crack 112 or irregularities on the surface of an object to be treated 111 as shown in the FIG. 12(*a*), electric charge is concentrated in the crack 112 or edge portion of the irregularities to grow a plating layer 113 therein as shown in the FIG. 12(*b*). At this stage, the object to be treated 111 and the hard granular substance 110 collide with each other since the object to be treated 111 and the hard granular substance 110 are stirred and flowed accompanied by the swing movement of the barrel 1, and the grown plating layer 114 is driven into the crack 112 and the hollow portion as shown in the FIG. 12(*c*) successively repeating the same action for growing another plating layer 114 on the edge portion. As a result, the irregularities on the surface and the crack are filled up by a plating layer 115 without scraping the surface of the object to be treated 111 and without forming a thick plating layer as shown in the FIG. 12(*d*). Thus, the hard and smooth surface granular substance 110 effectively polishes the surface of the object to be treated, and highly smooth surface can be easily obtained in a short period of time.

In the above embodiment, it is arranged to raise a plating effect by accommodating a conductive granular substance 88 in the barrel, however, in the case when sufficient plating effect can be obtained, accommodation of the conductive granular substance 88 is not necessarily required. Depending on a circumstance, it may also be arranged to combine the conductive granular substance 88 and the hard and smooth surface granular substance 110 by devising proper measures to a ceramic ball.

In each one of the embodiments described above, there are exemplified a surface washing, mirror finish, chemical polishing, plating, and pretreatment for plating, however, the present invention is not limited to those matters. It may also be applied to other various surface finish processes such as physical, electrochemical, and chemical surface finish processes. Since the fluidity of treatment liquid and granular substance can be raised by the swing movement of the barrel, contact of an object to be treated with the treatment liquid and granular substance is frequently performed to realize a uniform treatment.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A method for treating a surface of an object with a medium composed of treating liquid and a granular substance, comprising the steps of:

(a) placing treating liquid and a granular substance in a treatment barrel having an approximately horizontal axis of rotation, in an amount such that said treating liquid is shakable in said barrel, and said granular substance, the specific gravity of which is greater than that of said treating liquid, is submerged under said treating liquid in a stationary state of said barrel;

(b) placing at least one object to be treated bigger than the particles of said granular substance in said barrel in such a way that the surface of said object to be treated is submerged under said treating liquid;

(c) starting rotation of said barrel in one direction at a substantially constant velocity;

(d) detecting the angle of rotation of said barrel;

(e) mechanically stopping the rotation of the barrel when said barrel partially rotates and the detected rotation angle reaches a predetermined rotation angle;

(f) restarting rotation of said barrel in the reverse direction, at said constant velocity;

(g) detecting the angle of rotation of said barrel;

(h) mechanically stopping the rotation of the barrel when said barrel partially rotates and the detected rotation angle reaches a predetermined rotation angle; and (i) repeating steps (f)–(h) so as to partially rotate said barrel in reciprocating motion at said constant velocity except when the direction of the rotation is changed so that a predominant amount of said treating liquid and said granular substance within said barrel move in the direction of each rotation, to one side of said barrel defined by a vertical plane through the axis of rotation, for a time sufficient to treat the surface of said object.

2. The method for treating a surface of an object according to claim 1, wherein said treating liquid is washing liquid for washing the surface of said object, and said granular substance is formed of soft resin or elastic body.

3. The method as claimed in claim 1, wherein said liquid is polishing liquid, and the surface of the particles of said granular substance is smooth and harder than said object to be treated, whereby the surface of said object is mirror-finished.

4. The method as claimed in claim 1, wherein said barrel is provided with a basket therein for accommodating said object, said basket made of material permitting said granular substance to pass through but keeping said object inside.

5. The method as claimed in claim 4, further comprising the step of vibrating either said basket or said barrel during step (b).

6. The method as claimed in claim 1, wherein said treating liquid is plating liquid, and said barrel is provided with an electrode, whereby the surface of said object is plated.

7. An apparatus for treating a surface of an object with a medium composed of treating liquid and a granular substance, comprising:

a treatment barrel supported by a rotatable supporting shaft having an approximately horizontal axis in such a way as to enable said barrel to be partially rotated in reciprocating motion;

treating liquid and a granular substance, the particles of which are smaller than an object to be treated, and the specific gravity of which is grater than that of said liquid, said treating liquid and said granular substance being accommodated in said barrel in an amount such that said treating liquid is shakable in said barrel, and said granular substance is submerged under said treating liquid in a stationary state of said barrel; and a rotation drive for partially rotating said barrel through the supporting shaft in reciprocating motion substantially at a uniform velocity except when a direction of the rotation changes, comprising:

a driving motor capable of rotating reversely;

a rotation transmitter for connecting the driving motor and the supporting shaft;

a rotation angle detector for detecting an angle of rotation of the supporting shaft;

a drive controller for controlling the driving motor in such a way that the velocity of rotation of said barrel is substantially uniform except when the direction of rotation changes, and the direction of rotation is changed after the driving motor is stopped; and a brake for mechanically stopping the rotation of the barrel by braking said driving motor when the rotation angle detected with said rotation angle detector reaches a predetermined drive suspension rotation angle.

8. The apparatus for treating a surface of an object according to claim 3, wherein said treating liquid is washing liquid, and said granular substance is formed of soft resin or elastic body.

9. The apparatus as claimed in claim 7, wherein said barrel is provided with a basket therein for accommodating said object, said basket made of material permitting said granular substance to pass through but keeping said object inside.

10. The apparatus as claimed in claim 9, further comprising a vibrator for vibrating the basket.

11. The apparatus as claimed in claim 7, wherein the depth of said treating liquid above said submerged granular substance is less than one half of the depth of said submerged granular substance is a stationary state of said barrel.

12. The apparatus as claimed in claim 7, wherein said treating liquid is plating liquid, and said barrel is provided with an electrode.

13. A method for treating a surface of an object with a medium composed of treating liquid and a granular substance, comprising the steps of:

(a) placing treating liquid and a granular substance in a treatment barrel having an approximately horizontal axis of rotation, in an amount such that said treating liquid is shakable in said barrel, and said granular substance, the specific gravity of which is greater than that of said treating liquid, is submerged under said treating liquid in a stationary state of said barrel, wherein the depth of said treating liquid above said submerged granular substance is less than one half of the depth of said submerged granular substance;

(b) placing at least one object to be treated bigger than the particles of said granular substance in said barrel in such a way that the surface of said object to be treated is submerged under said treating liquid; and (c) partially rotating said barrel in reciprocating motion at a substantially constant velocity except when the direction of the rotation is changed, in such a way that a predominant amount of said treating liquid and said granular substance within said barrel move in the direction of each rotation, to one side of said barrel defined by a vertical plane through the axis of rotation, for a time sufficient to treat the surface of said object.

* * * * *